US010080391B2

(12) United States Patent
Rundle

(10) Patent No.: US 10,080,391 B2
(45) Date of Patent: Sep. 25, 2018

(54) RAIN GARMENT

(71) Applicant: Hugh J. Rundle, Webster, NY (US)

(72) Inventor: Hugh J. Rundle, Webster, NY (US)

( * ) Notice: Subject to any disclaimer, the term of this patent is extended or adjusted under 35 U.S.C. 154(b) by 0 days.

(21) Appl. No.: 15/656,617

(22) Filed: Jul. 21, 2017

(65) Prior Publication Data

US 2018/0092410 A1 Apr. 5, 2018

Related U.S. Application Data

(63) Continuation-in-part of application No. 15/283,823, filed on Oct. 3, 2016, now abandoned.

(51) Int. Cl.

| | |
|---|---|
| ***A41D 3/08*** | (2006.01) |
| ***A41D 27/20*** | (2006.01) |
| ***A41D 27/04*** | (2006.01) |

(52) U.S. Cl.

CPC ..... *A41D 3/08* (2013.01); *A41D 27/04* (2013.01); *A41D 27/201* (2013.01); *A41D 27/205* (2013.01); *A41D 2200/20* (2013.01); *A41D 2300/32* (2013.01); *A41D 2300/322* (2013.01); *A41D 2300/324* (2013.01); *A41D 2400/22* (2013.01)

(58) Field of Classification Search

CPC ..... A41D 3/08; A41D 15/00; A41D 27/10; A41D 2200/20; A41D 2300/324; A41D 15/04; A41D 15/002; A42B 1/006

USPC ..... 2/84, 87, 88

See application file for complete search history.

(56) References Cited

U.S. PATENT DOCUMENTS

| | | | |
|---|---|---|---|
| 1,099,031 | A | 6/1914 | Fligel |
| 1,374,301 | A | 4/1921 | Howard |
| 1,509,296 | A | 9/1924 | Hopewell |
| 1,556,390 | A | 10/1925 | Woodley |
| 1,993,149 | A | 3/1935 | Desmond |
| 2,051,437 | A | 8/1936 | Dorn |
| 2,103,608 | A | 12/1937 | Blauer |
| 2,144,875 | A | 1/1939 | Forrest |
| 2,334,061 | A | 11/1943 | Berkman |
| 2,452,475 | A | 10/1948 | Kraft |
| 2,500,982 | A | 3/1950 | Fligel |
| 2,547,931 | A | 4/1951 | De Grazia |

(Continued)

FOREIGN PATENT DOCUMENTS

DE 202014005760 U1 8/2014

OTHER PUBLICATIONS

Martone Cycling Co. RAINCAPE by Cleverhood. LuxeMode <http://www.luxemode.fr/objet/1413802.html> Mar. 9, 2014.

*Primary Examiner* — Alissa L Hoey

(74) *Attorney, Agent, or Firm* — Brian B. Shaw, Esq.; Alfred Y. Chu, Esq.; Harter Secrest & Emery LLP

(57) ABSTRACT

A garment in a preferred embodiment includes front, rear and first and second side panels and a hood all formed from a single piece of a high performance, water-proof, breathable material. The user may use releasable fasteners affixed above fixed connection points along each opposite side of the front and rear panels to adjust the size of the sleeve openings. Releasable fasteners are provided below the fixed connection points to allow the user to open or close the side edges of the front and rear panels below the fixed connection points. A plurality of releasable fasteners is provided along the bottom edges of the front and rear panels to allow the user to selectively adjust the fit about the user's torso.

9 Claims, 9 Drawing Sheets

(56) References Cited

U.S. PATENT DOCUMENTS 2,711,538 A 6/1955 De Cordero
D182,645 S 4/1958 Cetrulo
2,967,306 A 1/1961 Fabanich
3,144,660 A 8/1964 Portaro
3,665,518 A * 5/1972 Leadford ..... A41D 3/08 2/87
3,742,519 A 7/1973 Wiley
3,946,443 A 3/1976 Knight
3,968,803 A 7/1976 Hyman
4,064,562 A 12/1977 Kenny
4,078,264 A 3/1978 DeGennaro
4,118,802 A 10/1978 Polster
4,142,254 A 3/1979 Arnold
4,301,547 A 11/1981 Bloise
4,313,229 A 2/1982 Villafane
4,370,755 A 2/1983 Crumby
4,390,096 A 6/1983 Goldenberg
4,484,362 A 11/1984 Asher
4,554,682 A 11/1985 Hillquist
4,598,725 A 7/1986 Brewer
4,706,304 A 11/1987 Jones
4,752,971 A 6/1988 Meserol
4,825,469 A 5/1989 Kincheloe
4,866,790 A 9/1989 Ross, Jr.
5,077,838 A 1/1992 Senser
5,091,993 A 3/1992 Merrill et al.
5,099,526 A 3/1992 Baena
5,168,579 A 12/1992 Marshall
5,452,476 A 9/1995 Jenks
5,564,125 A 10/1996 Waldman
5,664,258 A 9/1997 Harris
5,697,102 A 12/1997 Benjamin
5,855,021 A 1/1999 Somerville
5,991,923 A * 11/1999 Maria ..... A41D 13/1236 2/114
6,014,772 A 1/2000 Connelly
D429,059 S 8/2000 Simmons
D430,721 S 9/2000 Beauchan
6,185,743 B1 2/2001 Mick
6,296,618 B1 10/2001 Gaber
6,327,711 B1 12/2001 Fujiwara
6,353,933 B1 3/2002 Love
6,360,370 B1 * 3/2002 Ferreras ..... A41D 3/04 2/69
D456,114 S 4/2002 Pyle et al.
6,454,125 B1 9/2002 Rink, Jr.
6,508,684 B2 * 1/2003 Cotten ..... A41D 13/0125 441/104
D472,694 S 4/2003 Pyle et al.
D478,708 S 8/2003 Miros
6,649,251 B1 11/2003 Druecke et al.
6,694,521 B1 * 2/2004 Hopkins ..... A41B 13/08 2/114
6,708,343 B1 3/2004 Ceron
6,742,191 B2 6/2004 Yang
6,859,942 B1 3/2005 Crafty
7,047,569 B1 5/2006 Mahon
7,178,185 B1 * 2/2007 Nattler ..... A41D 15/04 2/84
7,222,371 B2 5/2007 Houghton
D560,881 S 2/2008 D'Acquisto
D600,884 S 9/2009 Patton
7,765,611 B2 8/2010 Marshall
D638,612 S 5/2011 Benderradji
D672,534 S 12/2012 Smith
D677,859 S 3/2013 Andes
D679,484 S 4/2013 Brown
D683,523 S 6/2013 Freedman
D684,341 S 6/2013 Freedman
D713,126 S 9/2014 Franz
D714,524 S 10/2014 Borovicka
D722,421 S 2/2015 Jackson
D732,799 S 6/2015 Smith
9,420,833 B2 8/2016 Jenkins
2004/0000332 A1 1/2004 Yang
2004/0237167 A1 * 12/2004 Curry ..... A41D 3/08 2/88
2006/0010555 A1 1/2006 Hayes
2006/0288465 A1 12/2006 Delorenzo
2007/0250982 A1 * 11/2007 Norman ..... A41D 15/00 2/69
2009/0031473 A1 2/2009 Hartfield
2009/0070913 A1 3/2009 Park
2010/0064412 A1 3/2010 Slutzky
2011/0179548 A1 7/2011 Weston
2011/0258749 A1 10/2011 Hibbs
2012/0144550 A1 6/2012 Nejad
2012/0291178 A1 11/2012 Fu
2013/0019378 A1 1/2013 White
2013/0042384 A1 2/2013 Mitchell et al.
2013/0212772 A1 8/2013 Apostoloff
2013/0269082 A1 10/2013 Bramblet
2013/0318679 A1 12/2013 Esquer
2014/0345029 A1 11/2014 Saladino
2015/0013043 A1 1/2015 Peters
2015/0052661 A1 2/2015 Poznick
2015/0189924 A1 7/2015 Desbrow
2015/0250240 A1 9/2015 Hunkele
2015/0267911 A1 9/2015 Cushnie
2016/0015099 A1 1/2016 Saladino

* cited by examiner

RAIN GARMENT

BACKGROUND OF THE INVENTION

The present invention relates to protective garments for inclement weather, and more particularly relates to a garment in the general form of a hooded rain garment that is especially designed to protect a golfer's upper body from getting wet in the rain. While the invention as described herein is primarily directed as being worn by a golfer, it is understood that the benefits of the invention may be realized by any user type (e.g., athlete, spectator, tourist, worker, etc.) in any environmental condition (e.g., snow, rain, wind, hail, fog, ultraviolet rays, etc.) and outdoor setting (e.g., work site, sports, travel, leisure, stadiums, etc.). The invention is therefore not to be construed as being limited to any particular environmental condition, outdoor setting or user type.

Rain protection garments have been in use for a very long time and come in a variety of designs and materials. Two of the most basic deigns for covering the upper body are the jacket, which includes sleeves, and the sleeveless poncho, each of which may include a hood to cover the head. Of course the main function provided by either garment is to keep the upper body dry and thus may be made from a variety of available water resistant materials. The rain protection garments available on today's market continue to suffer certain drawbacks, some of which include the poncho type being too long and bulky for a golf swing and not having sufficient coverage when the arms are raised, as during a golf swing, for example. While the sleeveless poncho allows unrestricted arm movement for the golfer, the typical poncho design is completely open along the bottom such that areas of the upper body are exposed when the arms are raised. Strong winds also result in the poncho rising up and flapping. As a result, the golfer may still get wet despite wearing the poncho. While the rain jacket provides good coverage, the rain jacket sleeves seriously restrict the golfer's arm movements which may lead to a bad golf swing.

Regarding a hooded poncho, should the hood be too small, the user's head will get wet. Should the hood be too large, it may obstruct the user's view, particular as the head is rotated during a golf swing.

Rain jackets and ponchos, particularly those made of water proof materials such as polyurethane with a nylon or polyester outer layer, for example, have also been known to cause overheating of the user leading to profuse sweating. Should the user become drenched in sweat, they are no longer dry, thus defeating the purpose of the rain protection garment. Overheating can also be dangerous to the health of the user in that the increase in body temperature can lead to heat stroke. Even further, should the user remove the poncho and still be covered in sweat, cold temperature and/or wind could cause the user's body temperature to suddenly drop and lead to hypothermia. Breathable, water-resistant fabrics are known but some may nonetheless oversaturate and "wet out" over extended periods of time in a driving rain.

There thus remains a need for a rain garment which overcomes the drawbacks of present day sleeveless rain ponchos and jackets discussed above.

SUMMARY OF THE INVENTION

The present invention addresses the above needs by providing a hooded rain garment which covers the upper torso including the head, neck, shoulders and all or a portion of the arms. The rain garment includes a front panel and a rear panel each including side edges. The front and rear panel side edges are each fixed together at a single point and include strategically placed cooperative releasable fasteners both above and below the fixed connection point. This allows the user to easily find the sleeve opening when donning the garment and then, if desired for a closer fit, selectively attach one or more of the releasable fasteners together to adjust the fit as desired. For example, connecting the releasable fasteners above the fixed connection point forms an upper sleeve which is more closely fit to the user's arm at this location which may be desired when walking, for example. When ready to swing the club or to simply increase ventilation, for example, the user may quickly unfasten the releasable fastener which will provide a very loose fit around the user's arm allowing them freedom of movement which is beneficial while executing the golf swing. Releasable fasteners located along the sides and below the fixed connection point provide further options to the user. When these releasable fasteners are unattached, the front and rear panel side edges are open (separated) below the fixed connection point, again increasing freedom of movement and ventilation whenever desired. Closing these releasable fasteners provides protective coverage along the sides.

Additional releasable fasteners are provided along the bottom edges of the front and rear panels. In a preferred embodiment, at least two but preferably four releasable fasteners are provided in spaced relation along the bottom edges beginning at the opposite corners of the side and bottom edges. The user may selectively open and close the bottom edge releasable fasteners to adjust how close fitting the garment is to the user's body. A tighter fit provides more protection against the elements while a looser fit enables more freedom of movement and increased ventilation. The releasable fasteners may be in the form of snaps, for example.

The rain garment may further include an integrally formed hood such that there are no seams where water may pass through the garment. The hood may include a plurality of adjustable, releasable fasters allowing a user to fold the front edge of the hood back upon itself to provide a greater viewing area for the user. Each releasable fastener on the hood is adjustable so that the user can adjust how far back the front edge of the hood is folded back and also adjust one fastener to a different degree than another fastener, if desired. As discussed above, the user may wish to fold back the front edge of the hood when hitting a golf ball. Since each fastener is individually adjustable, the user may fold back a larger segment of the hood along the side facing the hole while a smaller segment of the hood is folded back and secured on the side facing away from the hole. After the ball is hit, the golfer may release the hood fasteners and unfold the entire hood front edge to provide more coverage and rain protection for the face while the golfer is walking to the location of the hit ball, for example. The hood also preferably includes a drawstring to provide adjustable coverage beneath the chin area. In the preferred embodiment, the front and rear panels and hood are formed from a single (unitary) piece of fabric.

In yet a further embodiment, the rain garment may include a pocket located on the user's body-facing side of the front and/or rear panels to hold personal items such as a cell phone and keys, for example.

The garment front panel may further include an opening extending from about the middle torso area up to and optionally including the lower opposite side panels of the hood. The opening may include an adjustable closure such as a zipper, snaps, buttons, or VELCRO, for example. The opening may further include an inner panel that spans and closes off the opening to provide a barrier to the elements in this location when the adjustable closure is opened. In a preferred embodiment, the panel seams are heat sealed along the thread holes to prevent moisture from entering through this area.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein.

DETAILED DESCRIPTION OF A PREFERED EMBODIMENT

Figure 1:
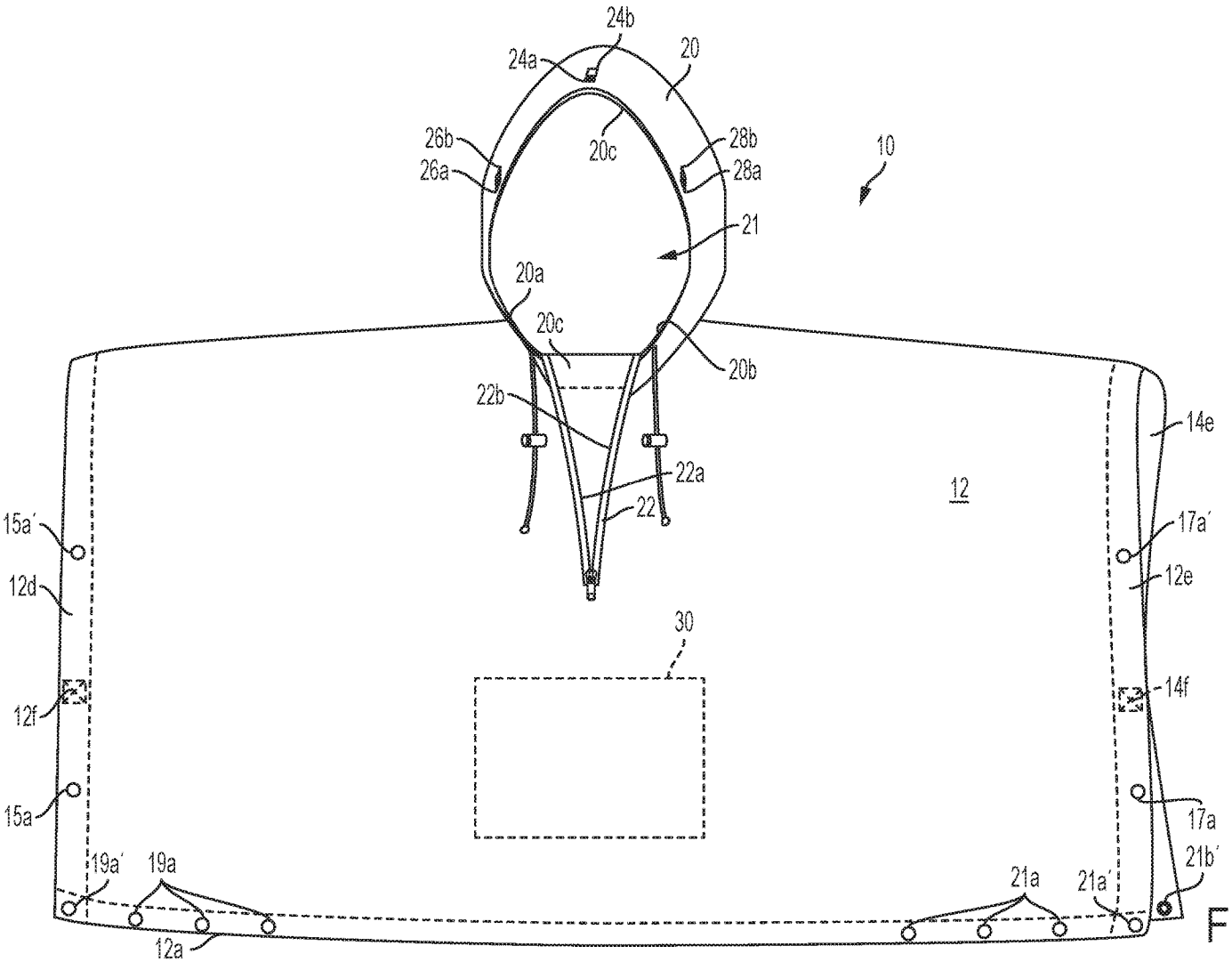
FIG. 1 is a front perspective view of an embodiment of the invention.
Figure 2:
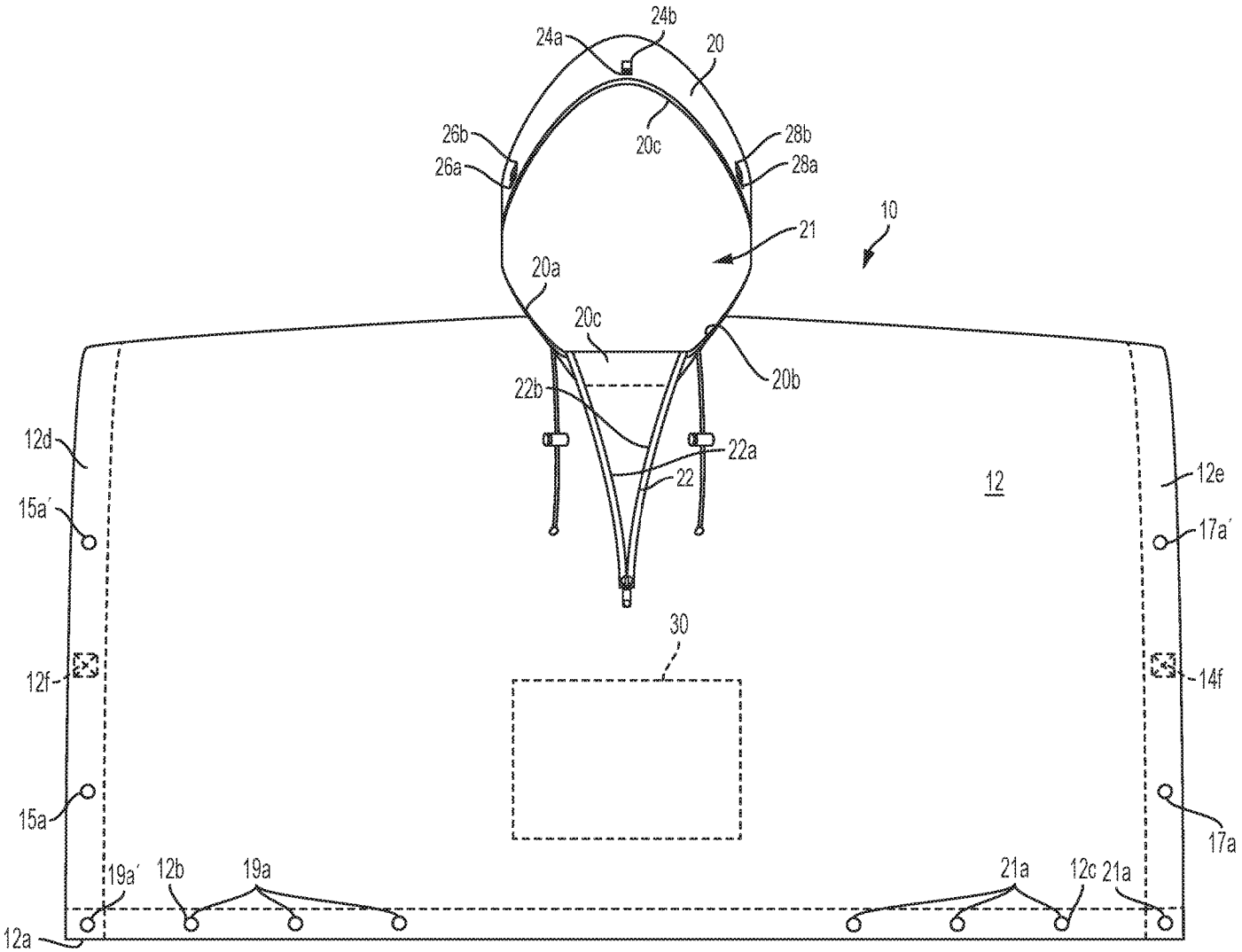
FIG. 2 is a front elevational view thereof.
Figure 3:
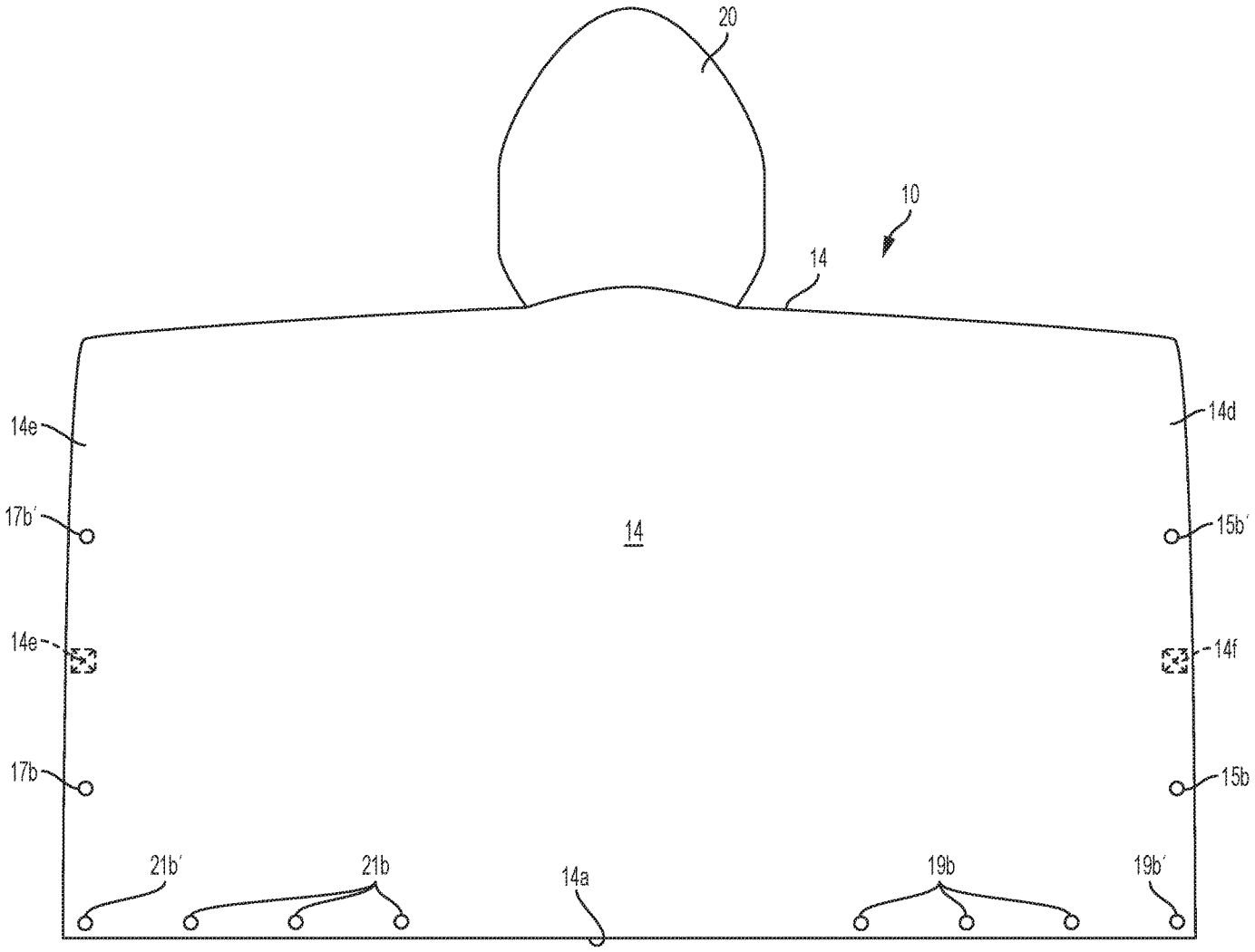
FIG. 3 is a rear elevational view thereof.
Figure 4:
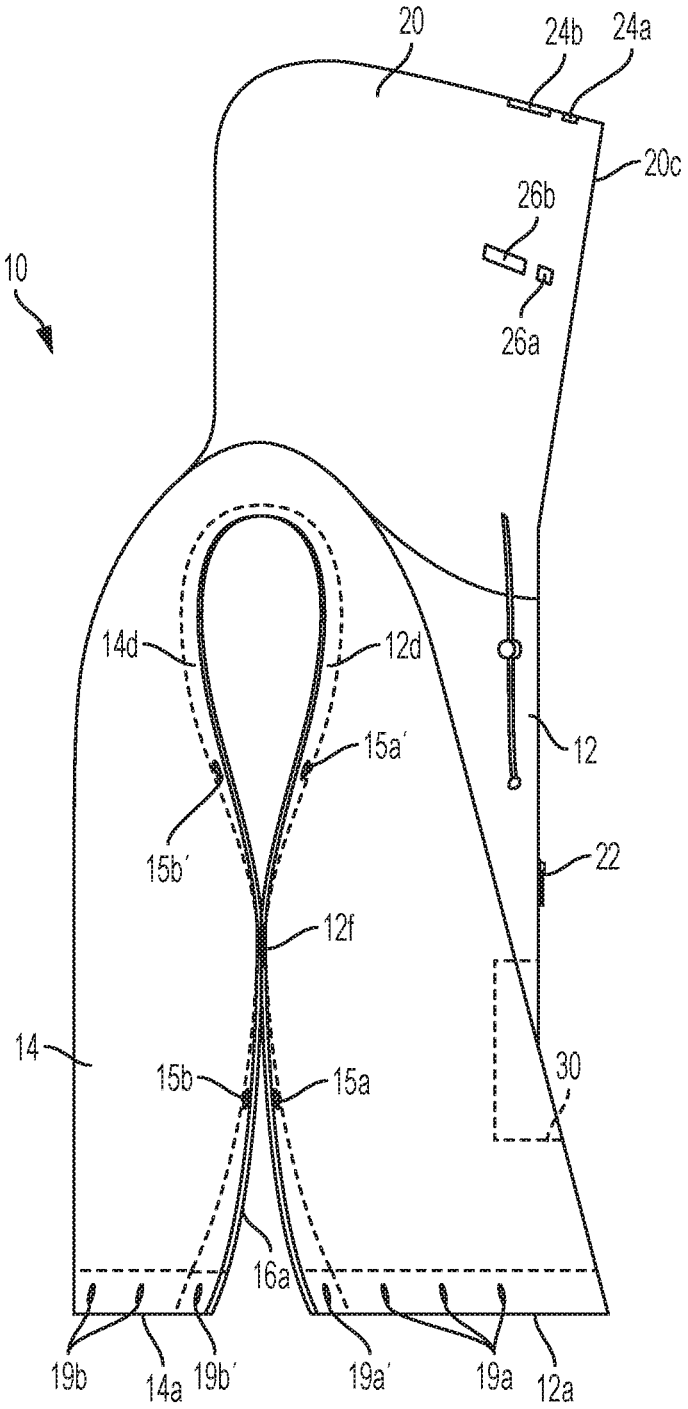
FIG. 4 is a right side elevational view thereof.
Figure 5:
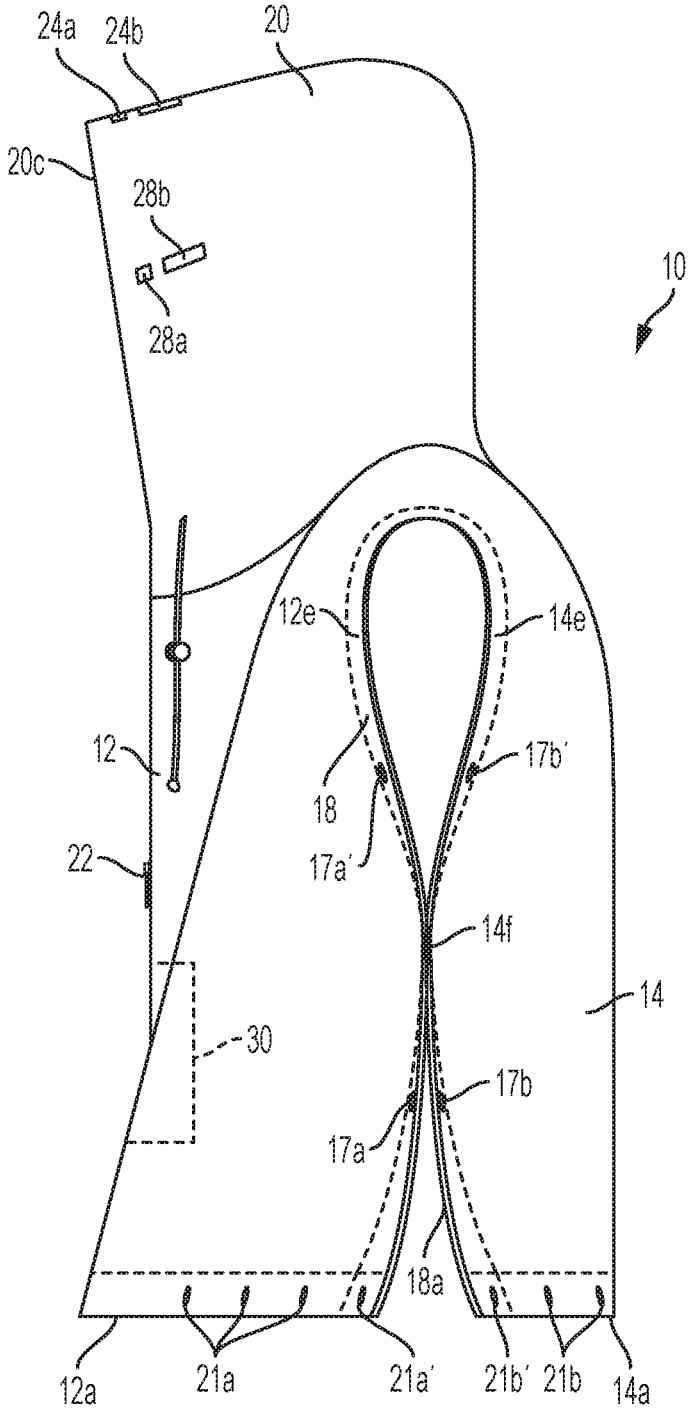
FIG. 5 is a left side elevational view thereof.
Figure 6:
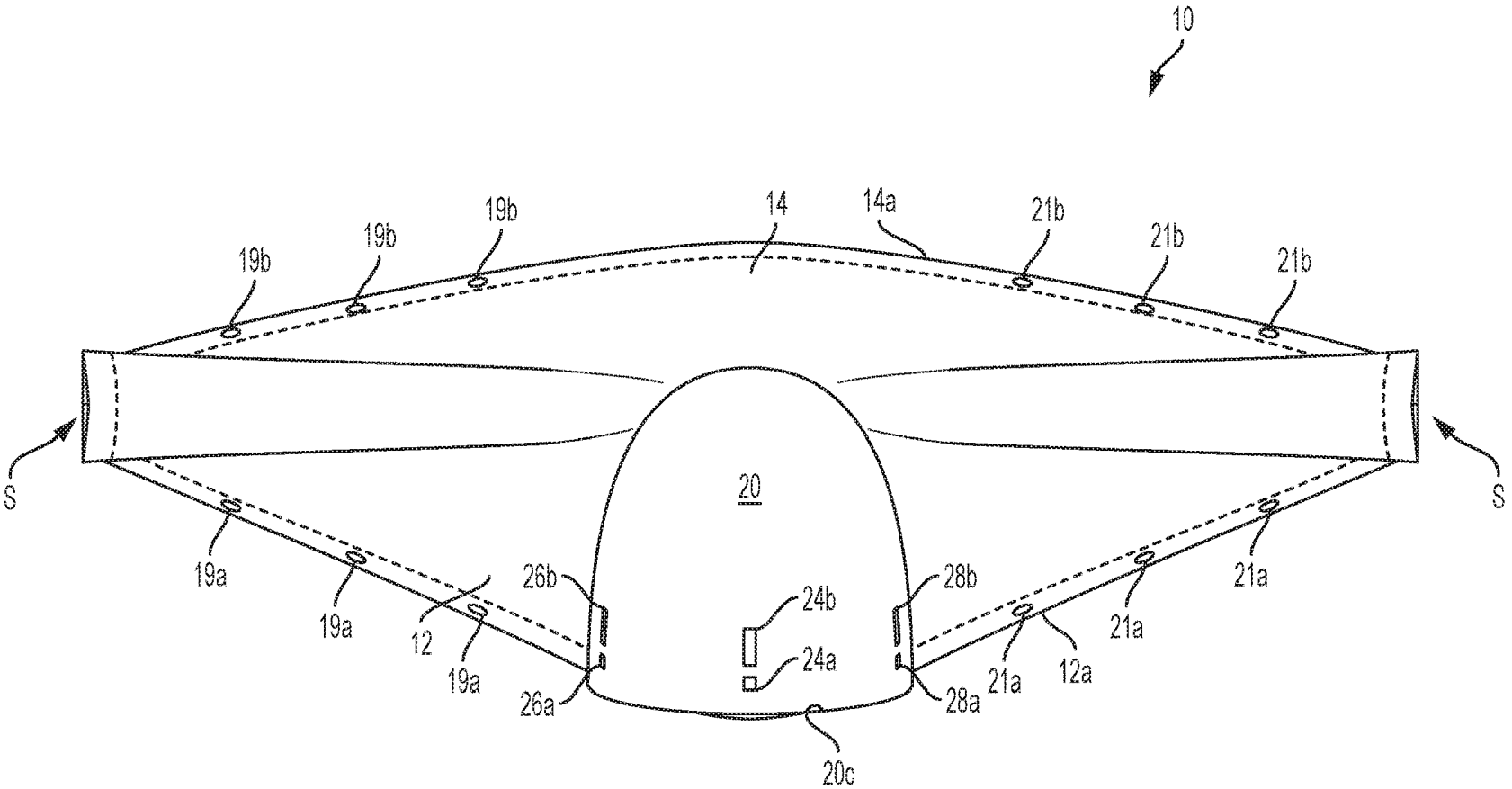
FIG. 6 is a top plan view thereof.
Figure 7:
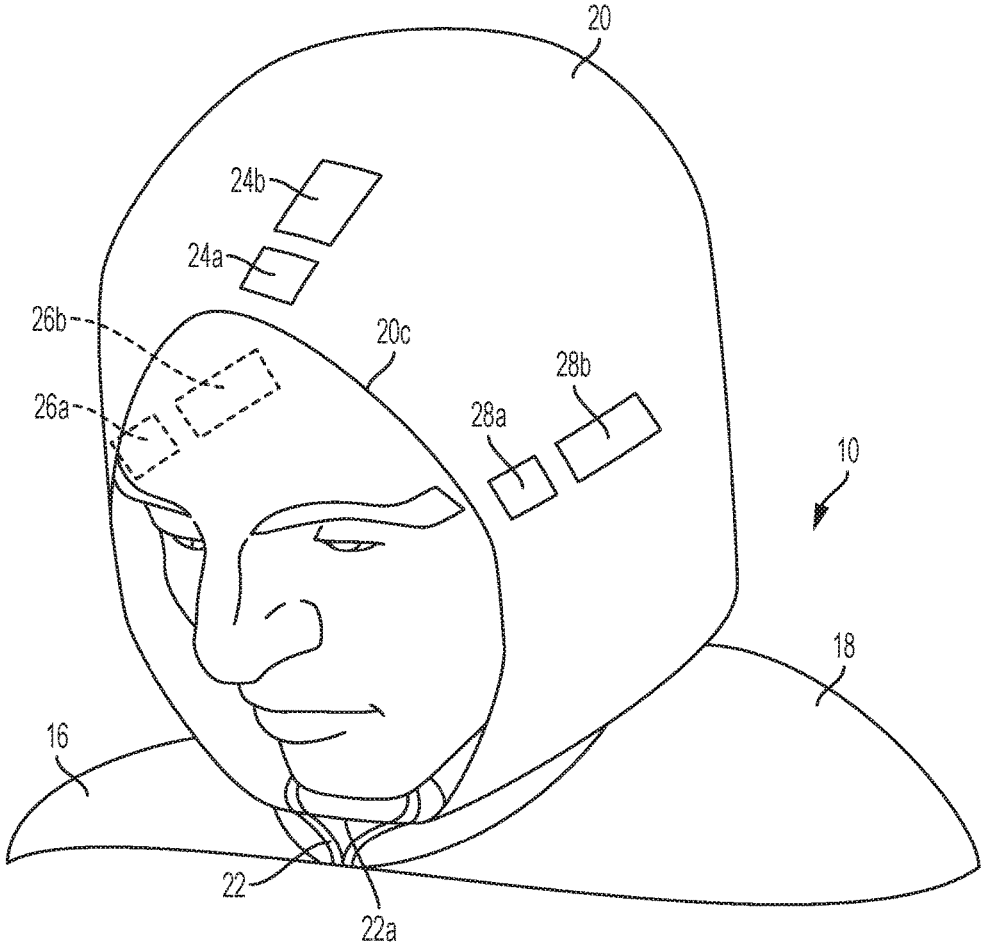
FIG. 7 is a partial front, perspective view showing the hood thereof in the unfolded condition on the head of a user.

Referring to the drawing, there is seen an embodiment of the invention in the form of a rain garment 10. The major portion of garment 10 is preferably, but not necessarily, formed from a single piece of fabric including a front panel 12 and a rear panel 14, respectively, and a hood 20 to form a head opening 21. The fabric may be a water-resistant material but is more preferably a high performance, breathable, water-proof material such as GORE-TEX, for example. Although not shown, a water-proof liner may be optionally provided to increase the water-proof rating of a garment made from a material that is otherwise not 100% waterproof. The liner may be removably attachable to the inwardly facing surface of the garment 10 when a drenching and/or freezing rain is expected, for example. This liner (or an additional liner) may be made of fleece, wool or other material to add warmth to the user.

The garment 10 may be offered as a "one size fits all" and/or in a variety of different overall sizes (e.g., child, adult, women's, men's, small, medium, large, extra-large, etc.). The lower edges 12*a* and 14*a* of the front and rear panels 12 and 14, respectively, of each size may also be offered at a variety of different lengths such that a user may select their desired garment length (e.g., short, medium and long) extending anywhere from the user's upper torso down to the waist, hips or knees, for example. The front panel 12 may also be of the same or different length as the rear panel 14. The lower edge of the garment may be of any desired shape (e.g., straight, curved, etc.). In the embodiment of FIGS. 1-10, the front and rear panels form a rectangle when laid flat as seen best in FIGS. 1-3.

Referring to FIGS. 1-7, the front panel opposite side edges 12*d*, 12*e* are each fixedly attached to the respective opposite rear panel side edges 14*d*, 14*e* at a single point labeled 12*f* and 14*f*, respectively, via sewing (as shown) or via a permanent adhesive or heat sealing, for example. Cooperative releasable fasteners 15*a*', 15*b*' and 17*a*', 17*b*' (e.g., snaps, as shown) are provided on the front and rear panels 12, 14, respectively, above fixed connection points 12*f* and 14*f* (toward the user's shoulders) adjacent front and rear panel side edges 12*d*, 12*e*, and 14*d*, 14*e*, respectively. Cooperative releasable fasteners 15*a*, 15*b* and 17*a*, 17*b* are provided on the front and rear panels below each fixed connection point 12*f* and 14*f* (towards the user's waist) adjacent front and rear panel side edges 12*d*, 12*e*, and 14*d*, 14*e*, respectively.

When it is desired to put on or take off garment 10, the user may release fasteners 15*a*', 15*b*' and 17*a*', 17*b*' above fixed connection points 12*f*, 14*f* which allows a larger opening "S" for passage of the user's arms therethrough (see also FIG. 10). When the user desires to have a closer fit around the arms, they simply join the fasteners 15*a*' and 15*b*' located above fixed connection point 12*f* adjacent side edges 12*d*, 12*e*, respectively, and join fasteners 17*a*' and 17*b*' located above fixed connection point 14*f* adjacent side edges 14*e*, 14*d*. If the user desires to close the garment along the sides below the fixed connection points 12*f*, 14*f*, they simply fasten the fasteners 15*a*, 15*b* located below the fixed connection point 12*f* adjacent side edges 12*d*, 12*d*, respectively, and join fasteners 17*a* and 17*b* located above fixed connection point 14*f* adjacent side edges 14*e*, 14*d*.

As seen in FIG. 10, releasable sleeve fasteners 15*a*', 15*b*' located above fixed connection point 12*f* are unfastened with the user's arm "A" extending through the enlarged sleeve opening "S". The size or area of sleeve opening "S" is the inside diameter of that portion of the side panel that surrounds the user's arm and this sleeve size/area "S" is adjustable. As such, the user may form a large, loose sleeve area "S" as seen in FIG. 10 which allows for complete free movement of the user's arms "A" which may be desired when performing a task such as a golf swing, for example. The user may selectively fasten the fasteners 15*a*', 15*b*' and 17*a*', 17*b*' above the fixed connection points 12*f*, 14*f*, respectively, to provide a closer fit around the arms. Likewise, the user may fasten the fasteners 15*a*, 15*b* and 17*a*, 17*b* located below the fixed connection points to close this area of the garment when desired.

Cooperative releasable fasteners 19*a*', 19*b*' and 21*a*', 21*b*' are provided at the opposite corners of the front and rear panels, respectively, with one or more cooperative fasteners 19*a*, 19*b* and 21*a*, 21*b* positioned in spaced relation along the bottom edges 12*a* and 14*a* of the front and rear panels, respectively. It will be appreciated that the provision of multiple, spaced fasteners 19*a*, 19*b* and 21*a*, 21*b* allow the user to selectively adjust the opening about the torso from a very loose fit (all fasteners unfastened), to a very close fit (all fasteners fastened). A looser fit may be desired when swinging the golf club, for example, and a closer fit may be desirable when walking in the rain and/or cold, for example.

A zipper 22 may be provided on front panel 12 extending from approximately the middle thereof up to and including the side panels 20*a* and 20*b* which form part of hood 20. An inner panel 22*c* may be provided which spans and closes off the area between the mating zipper side lengths 22*a* and 22*b* to provide a barrier to the elements in this location when the zipper 22 is opened. In a preferred embodiment, the seams securing the panel 20*c* to the zipper lengths 22*a*, 22*b* are heat sealed at the thread holes to prevent moisture from entering through this area. The zipper 22 is also preferably waterproof. Opening zipper 22 provides increased venting along the front should the wearer become overly heated and also aids in accommodating large head sizes and headgear equipment, for example.

Figure 8:
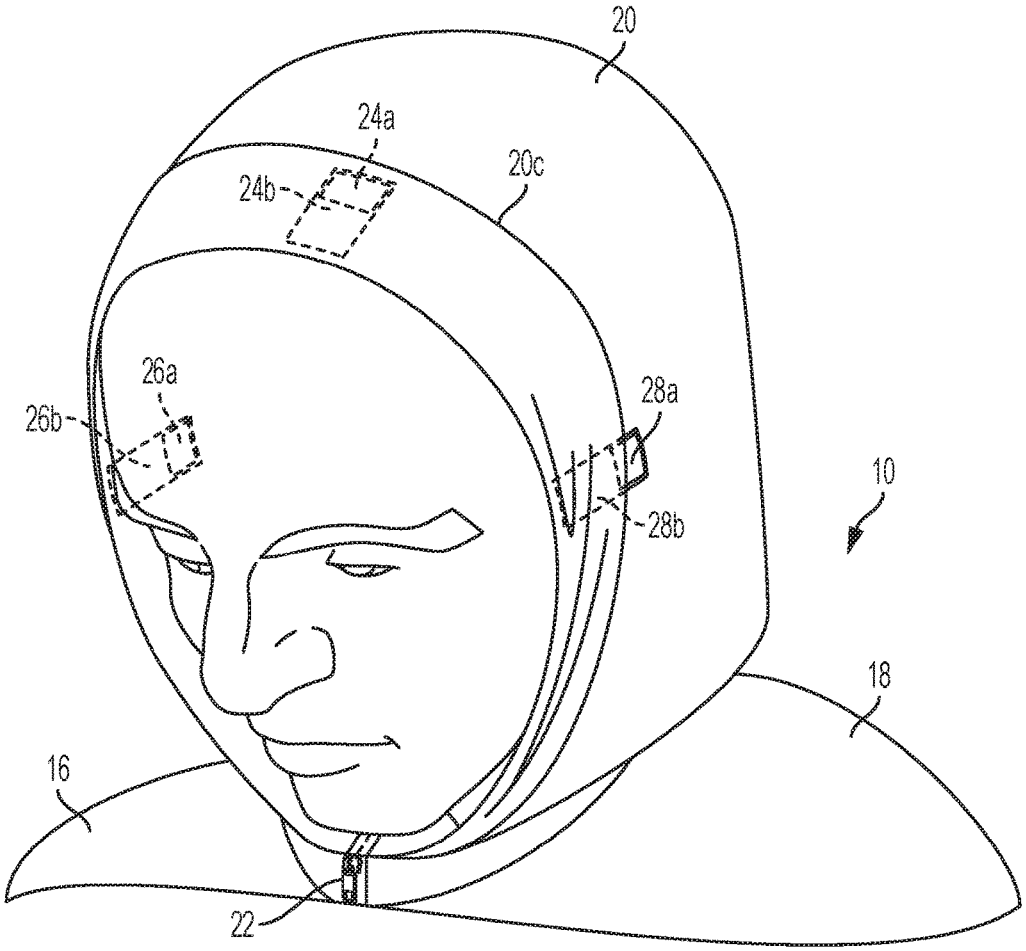
FIG. 8 is the view of FIG. 7 showing the hood thereof in the folded back condition on the head of a user.
Figure 9:
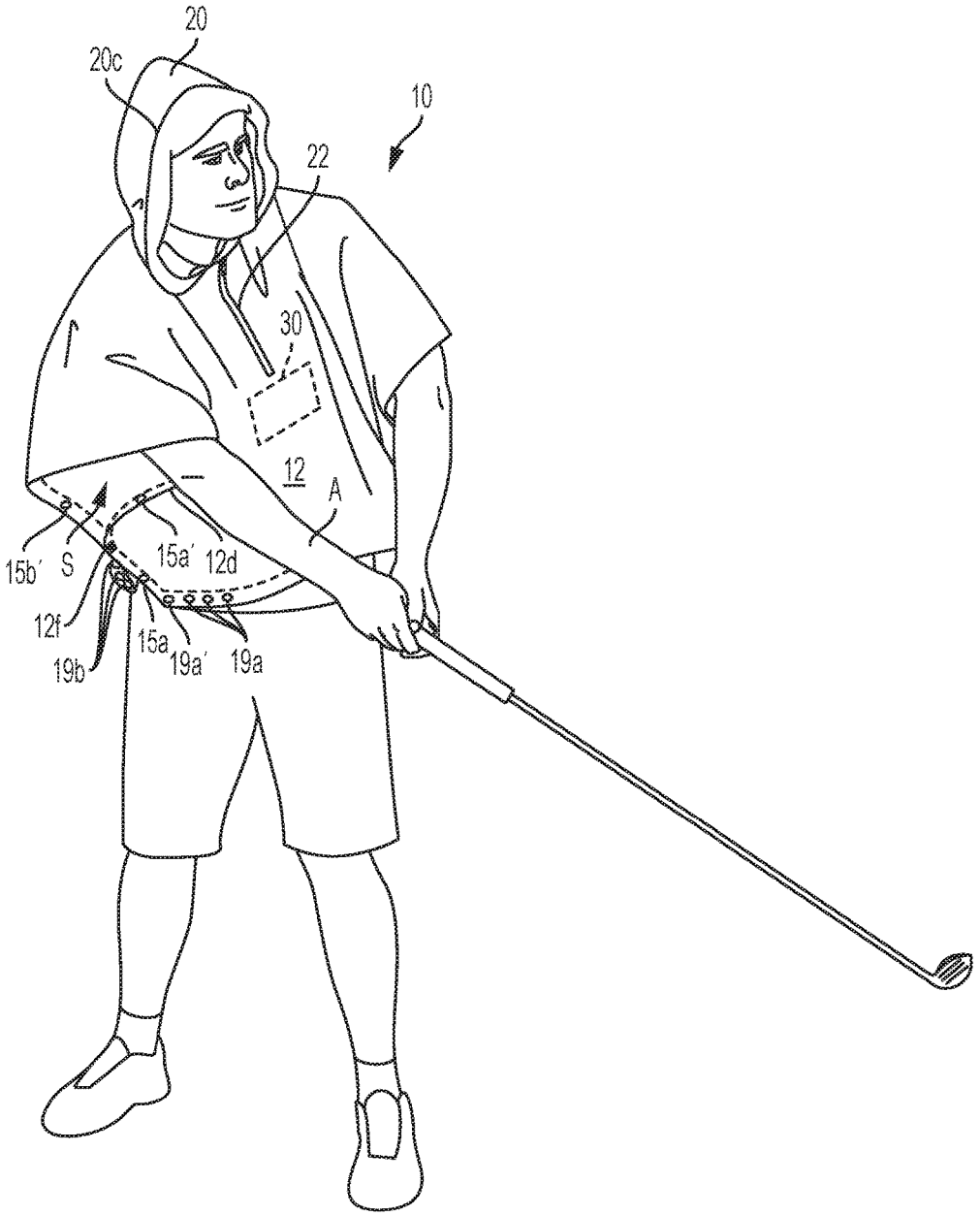
FIG. 9 is a front perspective view thereof with a golfer wearing the invention and in the middle of a golf swing.

As seen best in FIGS. 8 and 9, at least one, but preferably three pairs of releasable hood fasteners 24*a*, 24*b*; 26*a*, 26*b*;

and 28*a*, 28*b* are provided adjacent the hood front edge 20*c*. First releasable hood fastener pair 24*a*, 24*b* may be located adjacent the top of the head/hood 20 and third releasable hood fastener pair 26*a*, 26*b*, and fourth releasable hood fastener pair 28*a*, 28*b* may be positioned adjacent the temple areas of the head when a user dons the hood 20, respectively. The releasable hood fasteners 24*a*, 24*b*; 26*a*, 26*b*; and 28*a*, 28*b* may be of any desired type although in the preferred embodiment they are hook and loop fabric strips such as VELCRO. The releasable hood fasteners closest to hood front edge 20*a* are labeled 24*a*, 26*a* and 28*a* and may by relatively short in length compared to their mating releasable hood fasteners 24*b*, 26*b* and 28*b*, respectively. This allows the user to fold the hood front edge 20*c* rearward/outwardly upon itself (toward the back of the head) and apply the short releasable hood fasteners 24*a*, 26*a* and 28*a* at any location along the lengths of their mating releasable hood fasteners 24*b*, 26*b* and 28*b*, respectively. This allows the user to select and vary how far back the hood front edge 20*c* is folded back and thus allows the user to selectively vary and adjust where the leading edge of the hood facial opening comes to rest upon the user's head. The more forward the leading edge lies on the head, the more of the head is protected from the elements. This may be desirable when walking in rain, for example, where unobstructed lateral views are not required. When unobstructed lateral viewing is desired (e.g., when swinging a golf club), the user simply folds back the hood leading edge 20*c* which aligns and allows the user to secure the releasable hood fasteners 24*a*, 26*a* and 28*a* to their mating releasable hood fasteners 24*b*, 26*b* and 28*b*, respectively (see FIGS. 9 and 10). Once finished with the task (e.g., golf swing), the user may simply release each pair of releasable hood fasteners to unfold the hood and provide greater head coverage against the elements (see FIG. 8). It is also envisioned that a user may use a single fastener pair or any combination of fastener pairs, as desired.

As seen in FIGS. 1, 2, 4, 5 and 10, a pocket 30 may be provided on the surface of front panel 12 facing the user's body to secure and protect items from the elements (e.g., keys, phone, etc.). The pocket 30 may include a closure such as a zipper, for example. Additional pockets may be provided on the interior or exterior of front and rear panels 12 and 14 as desired.

Garment 10 may be made of any type of material which provides the desired amount of protection from the elements. In one preferred embodiment, the material is a high performance, water proof, breathable material such as GORE-TEX, for example.

While the invention has been shown and described with reference to certain preferred embodiments thereof, it will be understood by those skilled in the art that various changes in form and details may be made therein without departing from the spirit and scope of the invention as described.

What is claimed is:

1. A garment, comprising:

a) a unitary front panel, rear panel, and hood, said hood having interior and exterior surfaces and defining an opening between said front and rear panels configured for a user's head to pass therethrough, said front and rear panels being connected, said front and rear panels being permanently fixed together at first and second permanent connection points and thereby forming first and second sleeve openings between said front and rear panels and said first and second permanent connection points, respectively, said hood being configured to be adjustable and having a leading edge that is foldable outwardly from a first position to a second position such that a first section of said exterior surface of said hood fastens to a second section of said exterior surface of said hood when in said second position;

b) first and second releasable fasteners attached to said front and rear panels above said first and second permanent connection points, respectively, said first and second releasable fasteners being configured to selectively adjust a cross-sectional area of said garment about the user's arms;

c) third and fourth releasable fasteners attached to said front and rear panels below said first and second permanent connection points, respectively, said third and fourth releasable fasteners being configured to selectively open and close said front and rear panels below said first and second permanent connection points; and d) a first adjustable releasable fastener pair attached to said exterior surface of said hood, said first adjustable releasable fastener pair being configured to secure said leading edge of said hood in said second position to provide unobstructed lateral viewing by the user of said garment, said first adjustable releasable fastener pair being configured to variably secure said leading edge of said hood in said adjustable second position between a front side and a back side of said hood.

2. The garment of claim 1, and further comprising releasable fasteners at corners of said front and rear panels.

3. The garment of claim 2, and further comprising a plurality of releasable fasteners in linear spaced relation adjacent to bottom edges of said front and rear panels, said plurality of releasable fasteners being configured to selectively adjust the fit of said garment about the user's torso.

4. The garment of claim 1, and further comprising second and third adjustable releasable fastener pairs attached to said hood whereby said leading edge is foldable back upon itself which aligns and allows said second and third adjustable releasable fastener pairs to be releasably fastened together, respectively, said second and third adjustable releasable fastener pairs being configured to secure said leading edge in the folded position to provide unobstructed lateral viewing for the user of said garment.

5. The garment of claim 4 wherein said hood has a top and opposite first and second temple areas and said first adjustable releasable fastener pair is located adjacent said top of said hood and said second and third adjustable releasable fastener pairs are located adjacent said first and second temple areas of said hood, respectively.

6. The garment of claim 1 and further comprising a pocket configured to be affixed to an inner surface of said front panel which faces the user.

7. The garment of claim 1 and further comprising a zipper affixed to said front panel, the zipper including two series of opposed teeth.

8. The garment of claim 7, and further comprising a panel spanning between the two series of opposed teeth of the zipper.

9. The garment of claim 1 wherein said front and rear panels and said hood are formed from a single piece of a high performance, water-proof, breathable material.

* * * * *